United States Patent [19]

Pessier

[11] Patent Number: 4,759,415

[45] Date of Patent: Jul. 26, 1988

[54] ROCK BIT WITH IMPROVED EXTENDED NOZZLE

[75] Inventor: Rudolf C. O. Pessier, Houston, Tex.

[73] Assignee: Hughes Tool Company-USA, Houston, Tex.

[21] Appl. No.: 63,727

[22] Filed: Jun. 15, 1987

Related U.S. Application Data

[63] Continuation of Ser. No. 824,486, Jan. 1, 1986, abandoned.

[51] Int. Cl.[4] ..... E21B 10/60

[52] U.S. Cl. ..... 175/340; 175/424

[58] Field of Search ..... 175/339, 340, 424

[56] References Cited

U.S. PATENT DOCUMENTS

| | | | |
|---|---|---|---|
| 2,944,794 | 7/1960 | Myers | 175/340 |
| 3,329,222 | 7/1967 | Neilson | 175/340 |
| 3,363,706 | 1/1968 | Feenstra | 175/340 |
| 4,077,482 | 3/1978 | Ioannesian et al. | 175/340 |
| 4,239,087 | 12/1980 | Castel et al. | 175/340 |
| 4,240,513 | 12/1980 | Castel et al. | 175/340 |

OTHER PUBLICATIONS

Baker, W.: Extended Nozzle Two-Cone Bits Require Precise Nozzle Sizing for Optimum Performance, 1979 Drilling Technology Conference Transactions: pp. 153–169.

*Primary Examiner*—George A. Suchfield
*Attorney, Agent, or Firm*—Robert A. Felsman

[57] ABSTRACT

An earth boring bit with an improved extended jet nozzle constructed with a tube having only one curved entrance near the head of the bit and a straight region adjacent the exit of the nozzle, with the curved region being smoothly convergent without substantial disruption or deflective surfaces from a maximum cross sectional area adjacent the head to a minimum cross sectional area in the straight region. The velocity of the fluid flowing through the tube increases gradually from a minimum adjacent the head to a maximum at the exit, with the ratio of minimum to maximum being substantially three to one.

5 Claims, 2 Drawing Sheets

ROCK BIT WITH IMPROVED EXTENDED NOZZLE

This application is a continuation of application Ser. No. 06/824,486 filed 01/01/86, now abandoned.

BACKGROUND OF THE INVENTION

1. Field of the Invention

This invention relates to earth boring or rock bits—in particular to improvements in those bits having extended nozzles used to discharge drilling fluid closely against the bottom of a borehole.

2. Description of the Prior Art

The earliest rotary rock bits discharged drilling fluid in the borehole to cool the bit and wash cuttings to the surface of the earth. After World War II and the advent of high pressure pumps, the so-called "jet" bit improved drilling rates and bit life by discharging high velocity streams of fluid directly against the bottom of the bore hole.

It has been shown that further improvements are achieved by locating the nozzles close to the bottom of the borehole. As the nozzle is placed closer to bottom the pressure under the impinging jet increases. Best results are obtained when the jet is two to six nozzle diameters off bottom. For this reason the extended jet nozzle was developed to place the nozzles at the lower end of a tube that extends into proximity with the bottom of the hole.

On conventional three cone bits, which are designed to provide maximum bearing capacity and cutting structure intermesh, the space left for the placement of the nozzle extensions is a narrow curved passage.

Existing designs for nozzle extensions which fit into this space have disadvantages that should be overcome: (1) The fluid velocity in the curved sections of the extensions is frequently above the threshold level for erosion. (2) The fluid changes direction more than once through small radius curves, which intensifies erosion. (3) The section modulus of the nozzle extensions is essentially constant over the full length of the tube, resulting in low strength at the base of the tube, which can be regarded as a cantiliver beam when exposed to concentrated loads at its lower end due to contact with the borehole wall or debris on the bottom of the borehole. As a consequence extended nozzle bits have a reputation of short life and low reliability due to premature erosion as well as mechanical damage and breakage of the nozzle extension tubes. Frequently, the gain in penetration rate cannot offset the loss in bit life and increased risk.

SUMMARY OF THE INVENTION

It is therefore the general object of the invention to improve the flow characteristics of the fluid flowing through the extension tubes of rotary rock bits with extended jets and their structural integrity.

The objects of the invention are achieved by providing typically a three cone rock bit with a nozzle tube having an entrance connected to the head at a location above and intermediate each set of adjacent cutters and an exit region at an elevation near the lower extremity of the cutters and the bottom of the borehole.

The tube has a fluid passage generally circular in cross section, with a straight region adjacent the exit and one, single radius or curved region adjacent the head. The curved region is smoothly convergent without substantial disruption or deflective surfaces from a maximum cross sectional area adjacent the head to a minimum cross sectional area in the straight region.

Thus the fluid flowing through the nozzle extension attains its maximum velocity only in the straight region. Threshold velocities for erosion in straight tubes are many times higher than in the curved tubes. In the curved region of the preferred tube the velocity of the fluid increases gradually from a minimum at the entrance to a maximum at the beginning of the straight region.

In the preferred case the minimum and maximum cross sectional areas are selected such that the velocities of the fluid flowing through these areas differ by a ratio of substantially three to one.

Further, the preferred nozzle tube geometry has a gradually increasing section modulus through the curved region from a minimum in the straight region to a maximum at the entrance. Thus the nozzle tube is strongest where it is rigidly attached to the head and most susceptible to bending and breakage due to contact with the borehole wall or debris on the bottom of the borehole.

The above as well as additional objects, features, and advantages of the invention will become apparent in the following detailed description.

DESCRIPTION OF THE PREFERRED EMBODIMENT

Figure 1:
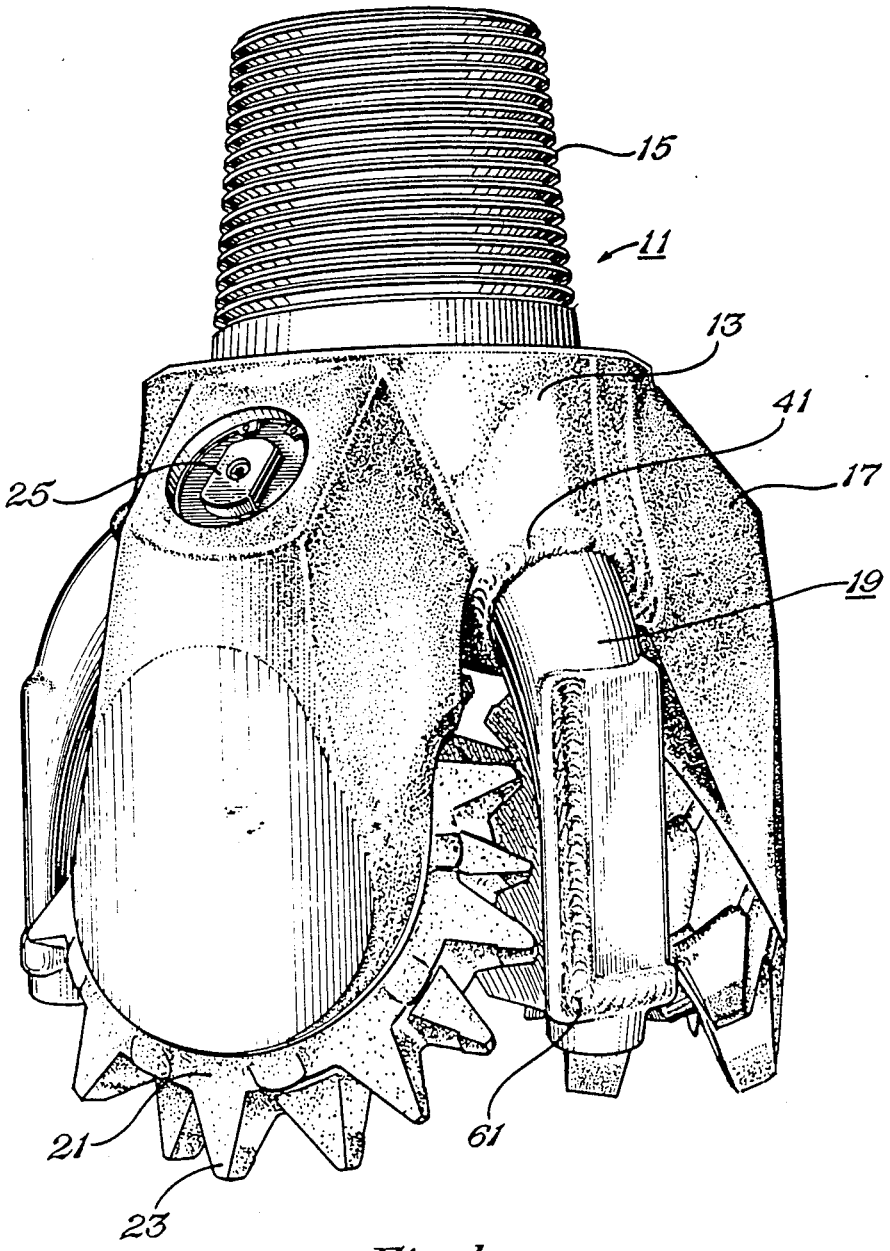
FIG. 1 is side elevational view of an earth boring bit of the rotating cone type, having extended jet nozzles constructed according to the principles of the invention.

The numeral 11 in the drawings designates an earth boring or rock bit having a head 13, threaded at 15 for connection to a drill string member. Depending from the heat are a plurality of head sections 17 and extended nozzle or jet tubes 19. The head sections each have a cantilevered bearing shaft (not shown) to support a rotatable cutter 21 having earth disintegrating teeth 23 to engage the bottom of a borehole during drilling.

The typical rock bit has seal means (not shown) between each cutter and bearing shaft as well as a lubrication system, only the exterior cap 25 of which is visible in FIG. 1. The seal means and lubrication system cooperatively maintain lubricant between each shaft and the interior of the associated cutter.

Figure 2:
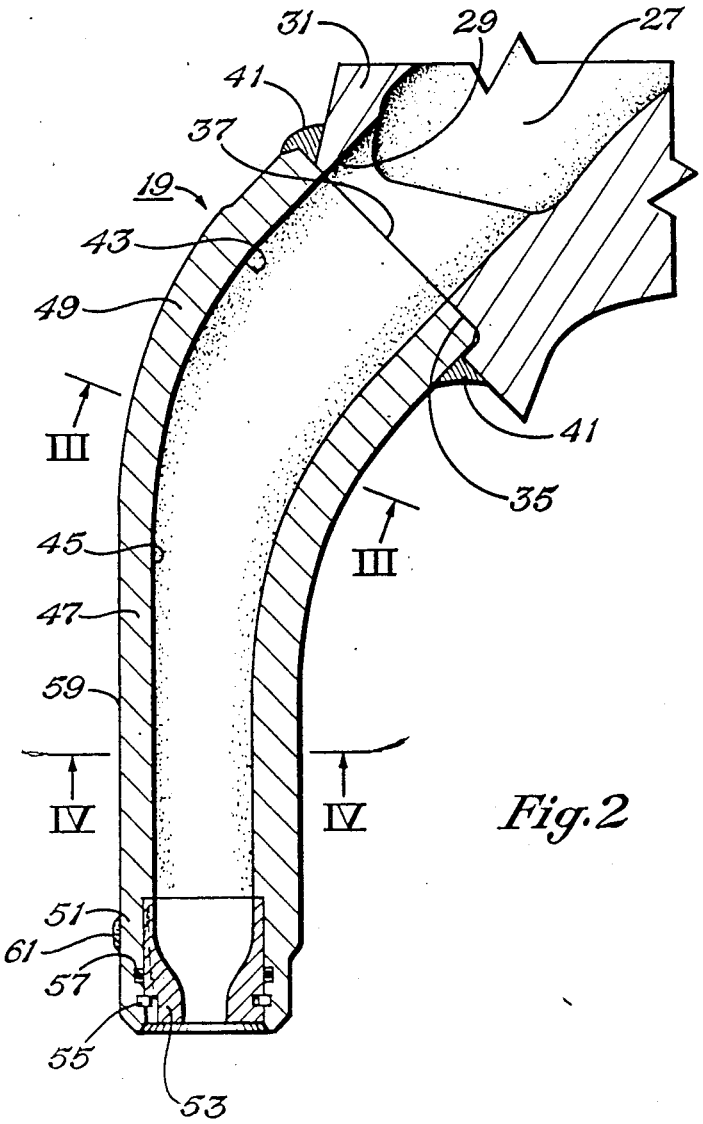
FIG. 2 is a fragmentary longitudinal section of a portion of the head of the bit shown in FIG. 1, the associated extended jet tube and a sintered tungsten carbide nozzle retained by a snap ring in the lower end of the tube.

With reference to FIG. 2, the head 13 has a cavity 27 with fluid passages 29 extending downwardly through the nozzle boss 31, which are located intermediate but at an elevation above the cutters 21. A flat surface 35 formed on the exterior of the boss 31 receives a registering flat end 37 of a nozzle or jet tube 19. Welding 41 extends around the exterior periphery of the upper end of the nozzle tube 19 to form a fluid sealed connection with the head 13.

An upper interior surface 43 inside the nozzle tube 19 is generally circular and coincident with the fluid passage 29 so that there is no disruption or deflective surface presented to fluid flowing from the head 13 to the nozzle tube 19. Also, surface or passage 43 converges from an entrance defined by the flat surface 37, which is a maximum cross sectional area, into coincidence with an interior surface 45 of a straight region 47 of the nozzle tube. Surface 45 thus defines a minimum cross sectional area for both the lower end of a curved region 49 of the nozzle tube 19 and the straight region 47.

Thus, the curved interior surface 43 of the curved region 49 of the nozzle tube 19 converges from a maximum cross sectional area adjacent the head to a minimum cross sectional area in the straight region 47. There are no disruptions or deflective surfaces presented to fluid flowing through the nozzle tube, and a minimum velocity is maintained at the upper, curved region of the tube while the maximum velocity is reached in the straight region 47. In the preferred embodiment the minimum and maximum cross sectional areas are selected such that the velocity of the fluid flowing through these areas differs by a ratio of substantially three to one.

Positioned in the lower end 51 of each nozzle tube 19 is a sintered tungsten carbide nozzle 53, retained in this instance by a snap ring 55 and sealed against the interior of the tube by an o-ring 57. The carbide nozzles are located within two to six nozzle diameters from the lower extremity of the cutters 21 since this is known to be the optimimum range. In this particular instance the ends of the nozzle are located $1\frac{5}{8}$ inch from the lower extremity of the cutters as seen on a design layout.

Figure 3:
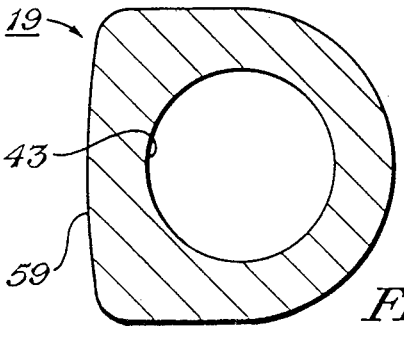
FIGS. 3 and 4 are cross sectional views as seen looking respectively along the lines III—III and IV—IV of FIG. 2.
Figure 4:
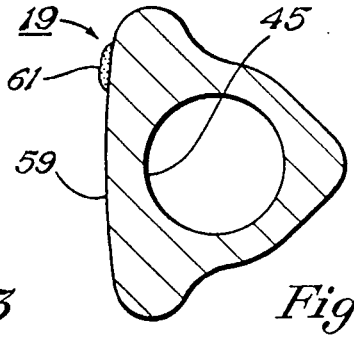

Viewing FIGS. 3 and 4, the outer surface 59 of the tube is reinforced relative to the remainder of the tube to maximize wear resistance, which may also be enhanced by the application of a surface treatment such as hardfacing 61. The remaining exterior surfaces of the tube have a configuration to maximize section modulus, and in the case of the straight region 47, a contour to provide clearance for the cutters 21 of the bit.

In operation drilling fluid is pumped through a drill string and the earth boring bit 11, both of which are rotated so that earth is disintegrated by the teeth 23 of the cutters and washed to the surface. The drilling fluid flowing through the FIGS. 1–4 embodiment is divided into four equal streams exiting from the cavity 27. Three streams exit through the bosses and one through the center of the bit through a conventional center jet (not shown). The lower end of the fluid passage through each boss is coincident with the upper interior surface of tube 43 to minimize turbulence and eddy currents. The interior of the tube is curved in an upper region 49 from a maximum diameter until it reaches the straight region 47, where there is a minimum diameter. Thus, the velocity of the fluid is a minimum at the entrance and is a maximum only in the straight region above the nozzle 53.

It should be apparent from the forgoing that an invention having significant advantages has been provided. The configuration of the nozzle tube assures that the average velocity in the convergent section will be less than the velocity in the straight section. The pressure loss through the tube has been significantly reduced by reducing the number of curved regions to one, decreasing the amount of curvature and gradually reducing the flow area through the curved region. The absence of disruptions an deflective surfaces reduces erosion inside the nozzle tube, as does the reduction of velocity in the curved region of the tube. Also, the increased section modulus at the entrance of the tube assures rigidity and long, failure resistant life.

While the invention has been described in only one of its forms, it should be apparent to those skilled in the art that it is not thus limited, but is susceptible to various changes and modifications without departing from the spirit thereof.

I claim:

1. An improved rock bit of the type having plural rotatable cutters secured to a bearing shaft depending from a head, and nozzle means to direct drilling fluid from passages in a cavity in the head against the bottom of a borehole, the improvement which comprises:

plural nozzle tubes, each with an entrance welded to the head, generally circular and coincident with a fluid passage in the cavity shaped to avoid disruptive or deflective surfaces to fluid flowing from the cavity with an exit region at an elevation near the extremity of the cutters and the bottom of the borehole during drilling;

each nozzle tube having a fluid passage generally circular in cross section, curved below the entrance and with a straight region adjacent the exit region and only one curved region adjacent the head;

the curved region being smoothly convergent without substantial disruptive or deflective surfaces from a maximum cross sectional area near the head to a minimum cross sectional area in the straight region with a configuration to have minimum fluid change direction and an incidence angle at the entrance of the tube and in the curved region to avoid fluid erosion in the tube;

whereby the velocity of the fluid flowing in the curved region increases gradually from a minimum in the bit head to the maximum in the straight region.

2. The invention defined by claim 1 wherein the minimum and maximum cross sectional areas are selected such that the velocity of the fluid flowing through these areas differs by a ratio of substantially three to one.

3. An earth boring bit with improved extended jet nozzles, which comprises:

a head with an upper end threaded for attachment to a drill string member and a cavity to receive drilling fluid, and depending bearing shafts;

plural cutters rotatably secured to respective bearing shafts, with teeth to engage and disintegrate the bottom of a borehole;

seal and lubrication means to lubricate each bearing shaft and associated cutter interior;

plural nozzle tubes, generally circular and coincident with a fluid passage in the cavity shaped to avoid disruptive or deflective surfaces to fluid flowing from the cavity, each entrance connected to the head at a location intermediate two cutters, with an exit region at an elevation near the extremity of the cutters and the bottom of the borehole during drilling;

each nozzle tube having a fluid passage generally circular in cross section, curved below the entrance and with a straight region adjacent the exit region and only one curved region adjacent the head;

the curved region being smoothly convergent without substantial disruptive or deflective surfaces from a maximum cross sectional area near the head to a minimum cross sectional area in the straight region with a configuration to have minimum fluid change direction and an incidence angle at the entrance of the tube and in the curved region to avoid fluid erosion in the tube;

whereby the velocity of the fluid flowing in the curved region increases gradually from a minimum at the entrance of each tube to a maximum in the straight region.

4. The invention defined by claim 3 wherein the minimum and maximum cross sectional areas are selected such that the velocity of the fluid flowing through these areas differs by a ratio of substantially three to one.

5. An earth boring bit with improved extended jet nozzles, which comprises:

a head with an upper end threaded for attachment to a drill string member, with a cavity and fluid passages to receive drilling fluid, and three depending bearing shafts;

a cutter rotatably secured to each bearing shaft, with teeth to engage and disintegrate the bottom of a borehole;

seal and lubrication means to lubricate each bearing shaft and associated cutter interior;

a nozzle tube with an entrance, generally circular and coincident with a fluid passage in the cavity shaped to avoid disruptive or deflective surfaces to fluid flowing from the cavity, and being connected to the head at a location intermediate two cutters, with an exit region at an elevation near the extremity of the cutters and the bottom of the borehole during drilling;

the nozzle tube having a fluid passage generally circular in cross section, curved below the entrance and with a straight region adjacent the exit region and only one curved region adjacent the head;

the curved region being smoothly convergent without substantial disruptive or deflective surfaces from a maximum cross sectional area near the head to a minimum cross sectional area in the straight region with a configuration to have minimum fluid change direction and an incidence angle at the entrance of the tube and in the curved region to avoid fluid erosion in the tube;

the minimum and maximum cross sectional areas being such that the velocity of the fluid flowing through these areas differs by a ratio of substantially three to one;

whereby the velocity of the fluid flowing in the curved region increases gradually from a minimum at the entrance of the tube to a maximum in the straight region.

* * * * *